United States Patent [19]

Petersen et al.

[11] Patent Number: 4,681,533

[45] Date of Patent: Jul. 21, 1987

[54] VAPOR BURNER FOR LIQUID FUEL

[75] Inventors: Jørgen H. Petersen; Peter J. M. Clausen, both of Nordborg, Denmark

[73] Assignee: Danfoss A/S, Nordborg, Denmark

[21] Appl. No.: 759,356

[22] Filed: Jul. 26, 1985

Related U.S. Application Data

[63] Continuation of Ser. No. 550,318, Nov. 11, 1983, abandoned.

[30] Foreign Application Priority Data

Nov. 24, 1982 [DE] Fed. Rep. of Germany ..... 3243398

[51] Int. Cl.[4] ..... F23D 11/44

[52] U.S. Cl. ..... 431/208; 431/115

[58] Field of Search ..... 431/208, 215, 187, 183, 431/173, 171, 115

[56] References Cited

U.S. PATENT DOCUMENTS

| | | | |
|---|---|---|---|
| 2,904,417 | 9/1959 | TeNuyl | 431/123 |
| 4,318,689 | 3/1982 | Foster | 431/208 |
| 4,396,372 | 8/1983 | Matumoto | 431/208 |
| 4,472,133 | 9/1984 | Petersen et al. | 431/208 |
| 4,497,625 | 2/1985 | Petersen et al. | 431/208 |
| 4,515,555 | 5/1985 | Petersen et al. | 431/208 |

FOREIGN PATENT DOCUMENTS

| | | | |
|---|---|---|---|
| 1165169 | 9/1969 | United Kingdom | 431/350 |

*Primary Examiner*—Samuel Scott
*Assistant Examiner*—H. A. Odan
*Attorney, Agent, or Firm*—Wayne B. Easton; Clayton R. Johnson

[57] ABSTRACT

In a vapor burner for liquid fuel there is an electrically heatable gasifying chamber (1), a passage system (K) concentric therewith for supplying air of combustion, and a burner tube (26) which surrounds a combustion chamber (25) and is bounded at the rear by an annular closure wall (22). The gasifying chamber (1) is formed substantially by a central gasifying tube (2). Guide means (19) serve to produce an external annular eddy (31) of combustion gases that extends along the inside (33) of the burner tube (26) rearwardly at least over a section disposed axially in front of the mouth (23) of the passage system (K). An ionisation measuring electrode (35) placed in the backward flow permits the flame to be accurately detected independently of the flame front which changes with a change in the burner output. When the burner tube (26) glows, there is automatic re-ignition if the flame blows off.

24 Claims, 4 Drawing Figures

VAPOR BURNER FOR LIQUID FUEL

This application is a continuation of application Ser. No. 550,318, filed Nov. 11, 1983, now abandoned.

The invention relates to a vapour burner for liquid fuel, comprising an electrically heatable gasifying chamber, a passage system concentric with the gasifying chamber for supplying air of combustion, and a cylindrical burner tube which surrounds a combustion chamber and is bounded at the rear by an annular closure wall.

In a known vapour burner of this kind (VDI Reports No. 423, 1981, pages 175 to 180), the gasifying chamber consists of a plurality of parallel passages of small cross-section accommodated in a hollow cylinder and surrounded on the outside by a heating coil. The outlet apertures of the gasifying chamber are provided at the circumference of the hollow cylinder and open into an annular gap through which the air of combustion is supplied with twist. The mouth of this annular gap is at a considerable axial spacing in front of the rear closure wall of the combustion chamber. The gaseous fuel-air mixture, which can be ignited in the annular gap by means of spark ignition, forms an annular eddy with a recirculation path which leads through the hollow cylinder so that hot combustion gases can be mixed with the freshly supplied air of combustion at the inlet to the annular gap.

With this construction, operation is possible with a blue transparent flame and considerable excess air, e.g. 45% at 12 KW power, as soon as the burner has reached the normal operating condition and an adequate amount of fuel is being fired. With small amounts of fuel, even more excess air must be employed to permit stable operation. Difficulties can also arise during starting as a result of flame instability.

The invention is based on the problem of providing a vapour burner of the aforementioned kind which can be operated over its entire power range with a blue flame and little or no excess air.

This problem is solved according to the invention in that the gasifying chamber is formed substantially by a central gasifying tube and that guide means are provided for producing an external annular eddy of combustion gases that extends along the inside of the burner tube back to the closure wall at least over a section disposed axially in front of the mouth of the passage system into the combustion chamber.

With this construction, a central flame front is formed because of the central gasifying tube. The outer annular eddy formed by the guide means leads back hot combustion gases between this flame front and the inner periphery of the burner head. A weak flame at low burner output is thereby protected from being cooled to below ignition temperature and extinguished by the (as yet) cold wall of the burner tube. Consequently, the vapour burner can be operated at a much lower thermal power than has been possible hitherto. Nevertheless, the amount of excess air can be kept small. This protection of the flame by the outer annular eddy also applies to every kind of starting when there is a danger of the flame that has just been formed being extinguished again under the influence of the initially low temperature of the burner tube. The outer annular eddy has the additional advantage that, at the edge of the flame front, any unburnt fuel particles that may be present are again fed to the flame front so as to ensure combustion.

With particular advantage, a glow zone for ignition is disposed near the mouth of the gasifying tube. When, on switching on the burner, the first drop of fuel evaporates in the gasifying tube, it will mix with the air contained therein to form a combustible mixture which is ignited in the glow zone. The ignition flame thus formed is pushed out into the combustion chamber by the subsequent gaseous fuel so that the subsequently formed fuel gas mixture can also ignite. The stability of the ignition flame is very considerably improved by the outer annular eddy so that, with a gentle start, a stable frame front can be reached rapidly.

Desirably, the mouth of the passage system is disposed in the combustion chamber substantially in the region of the closure wall. This particularly ensures that the annular eddy being formed axially projects into the combustion chamber comparatively far and therefore sufficiently surrounds the flame front.

The at least one output aperture of the gasifying tube should also be disposed in the vicinity of the closure wall. This provides the shortest possible spacing of the flame front from the closure wall and it is therefore most likely that the outer annular eddy will surround the frame front.

In a preferred embodiment, the guide means comprise a conical guide wall at least on one side so that the air of combustion is introduced as a conical air jet. In conjunction with the vaporised fuel supplied by the gasifying tube, the conical air jet leads behind the apex of the cone to a flame front which diverges outwardly. The outer annular eddy is formed by the outer combustion gas layer which is initially directed forwardly and then diverted rearwardly to a vacuum zone formed by the entering conical jet. When the thermal power is changed by altering the fuel supply and air of combustion, the flame front is axially displaced in the combustion chamber. At the same time, however, the creation of the annular eddy brought about by the conical jet is changed so that the flame front will continue to be enveloped by the outer annular eddy.

The conical guide wall should be axially adjustable relatively to the second wall bounding the mouth. In this way, the outer annular eddy can be set to an optimum.

The passage system can be designed so that the supplied air of combustion enters the combustion chamber rotatingly by way of the annular mouth at a high velocity brought about by a pressure loss of 15 to 100 mbar across the mouth. The main proportion of the pressure energy is thereby converted to velocity energy. In this case, the twist given to the air of combustion by introducing it tangentially into the passage system will suffice to produce proper mixing with the gasified fuel and a marked formation of the outer annular eddy. In addition, pressure fluctuations in the combustion chamber caused by atmospheric and other influences are practically without effect. An optimum value is a pressure of about 40 mbar in the passage system.

It is, however, also possible to work with lower pressures than 15 mbar in the passage system. In that case, to achieve the marked outer annular eddy, the guide means should include guide blades in the passage system to give the air of combustion a sufficient twist.

In another embodiment, the guide means comprise a guide tube extending at a spacing within the burner tube and together therewith forming a return flow passage at least for an outer part of the outer annular eddy. This guide tube imposes constant flow, which serves to protect the flame.

Constructionally, it is advisable for the guide tube to be secured to the closure wall, to be provided with circumferential apertures in this region and for an axially displaceable stop to cover part of the aperture cross-section. By means of the stop, one can influence the amount of combustion gases returned in the flow passage.

In a further development of the invention, one or more circumferentially uniformly distributed connecting passages may lead from the return flow passage to the mouth of the passage system and extend behind the closure wall for the combustion chamber enclosed by the guide tube. In this way, at least an outer portion of the outer annular eddy is returned to a position where the highest air speed and lowest pressure occur. With this type of recirculation, it is more certain that any liquid fuel that is still present will be vaporised by the recirculating gases before it reaches the flame front. Apart from this, an inner portion of the outer annular eddy can pass through a recirculation path within the guide tube.

It is also advisable to have a constructional unit which comprises the closure wall and a cylindrical flange surrounding same for holding the guide tube, an end wall of the return flow passage axially offset with respect thereto, an outer guide wall of the guide means with a minimum cross-section, and at least one connecting passage which starts between the end edge and closure wall and multistop in the region of the minimum cross-section multistop until can be readily premanufactured and then unified with the burner head surrounding the air system, the burner tube and the guide tube.

In addition, the constructional unit may carry twisting guide blades at the side facing the passage system to result in a particularly compact and reliable construction.

It is favourable for the constructional unit to consist of several parts which have aligned axial holes through which the connecting pins engage. Since the constructional unit ought to be made from a heat-resistant material, particularly ceramic material such as magnesium silicate, cordierite, aluminum oxide, silicon nitride and the like, because it can only be formed in comparatively simple parts, one can in this way also produce complicated constructional units.

It has been proved desirable for the front end of the burner tube to be provided with a baffle ring adjoining the inner periphery. This baffle ring facilitates the formation of the outer annular eddy because the discharged combustion gases are limited to the smaller cross-section defined by the baffle plate.

The burner tube should be heat insulating and preferably at least partially consists of a heat-resistant material having a low thermal conductivity. This ensures that the burner tube will warm up rapidly and no longer have a negative influence on the flame.

Particular advantages are obtained if the thermal conductivity is so low that the burner tube will glow in the region of the outer annular eddy. This will ensure that the flame will be re-ignited if it is momentarily extinguished. In this case the burner power can be still further reduced.

Further, a switching apparatus may be provided which, with a time delay after switching on, reduces the power to be supplied to the heating apparatus of the vapour burner. This saves electric energy. Insufficient vaporisation of the fuel is not harmful because any droplets of fuel that are carried along are evaporated by the returned hot combustion gases or by the heat radiated from the burner tube.

It is also favourable if, for the purpose of monitoring the flame, at least one ionisation measuring electrode is provided in the rear closure wall or in the burner tube or guide tube near said closure wall where it is disposed in the return flow of the outer annular eddy. The ionisation measurement with a fixed electrode projecting into the flame leads to unstable results because the position of the flame front and the length of the flame change with an adjustment in the power of the burner. By arranging the ionisation measuring electrode in the return flow of the outer annular eddy, one ensures that always the same conditions will obtain at the measuring path, irrespective of the position of the flame front and the length of the flame.

Such a measuring electrode can also serve as a connecting pin for assembling the parts of the constructional unit.

It is also recommended to provide a control device which, if the flame is blown off, switches off the fuel supply only at the end of a predetermined safety period if the measuring electrode and/or walls of the combustion chamber are at a glow temperature. When these parts have a temperature of over 600° C., re-ignition will occur without any special measures. It is therefore not necessary to conduct a complete starting cycle every time.

Preferred examples of the invention will now be described in more detail with reference to the drawing, wherein.

Figure 1:
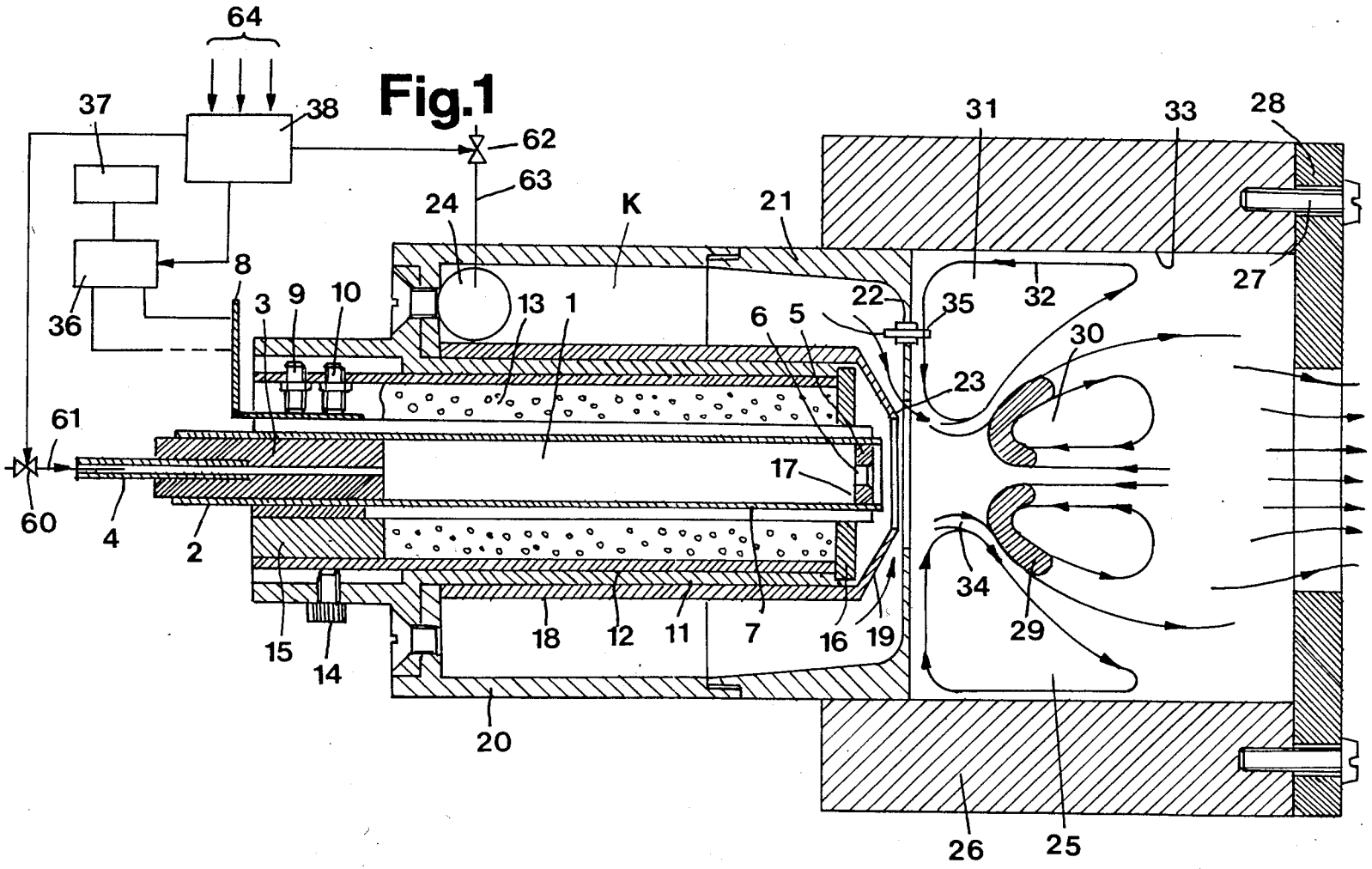
FIG. 1 is a longitudinal section through a first embodiment of a vapour burner according to the invention.

FIG. 1 shows a gasifying chamber 1 formed substantially by a gasifying tube 2. A holder 3 inserted in the rear end serves to make a connection with a fuel supply tube 4, for example a normal capillary tube of stainless steel. The front end of the gasifying tube 2 is closed by an apertured plate 5 having a central outlet aperture 6. Around the tube there is a heating apparatus 7, for example in the form of a sleeve of electrically conductive material which is slotted several times from opposite sides and once or twice with throughgoing slots. Current can be supplied through terminals 8 pressed to the heating apparatus 7 with the aid of screws 9, 10. The screws 9, 10 can be supported against an insulating sleeve 12 held in a housing 11. Thermal insulation 13 is provided between the insulating sleeve 12 and heating apparatus 7. Screws 14 supported at the housing 11 are effective in the region of a spacer ring 15 which contains recesses for the terminals 8 and thereby secure the position of the gasifying tube 2. At the front, the housing is closed by an annular disc 16 of thermally insulating material. Because of the poorer dissipation of heat, heating will produce within the gasifying tube 2 a zone of increased temperature, which is the so-called glow zone 17. The thermal insulation 13 can be of ceramic fibres, aluminum oxide, silicon dioxide or the like. The other parts are preferably ceramic or metallic parts having the required high thermal resistance. In particular, the gasifying tube 2 is of silicon dioxide. With an electrically conductive tube material, the heating current can also be fed directly through the tube so that the special heating apparatus 7 is omitted.

A passage system K for the supply of air of combustion is provided concentrically with the gasifying chamber 1. It is bounded on the inside by a sleeve 18 which is pushed over the housing 11 and has a conical front guide wall 19 and on the outside by a burner head 20 with an end portion 21 having an annular closure wall 22. Between the conical wall 19 and the closure wall 22 there is formed a mouth 23 in the form of an annular gap through which air of combustion tangentially supplied through an inlet 24 is delivered as rotating conical jet. The front opening in the closure wall forms the inlet to the combustion chamber 25. As may be seen from FIG. 1, the diameter of the combustion chamber inlet is smaller than the maximum diameter of the conical wall 16 while the outer diameter of the closure wall 22 is greater than the maximum diameter of the conical wall.

The gasifying chamber 1 is preceded by a combustion chamber 25 which is bounded on the outside by a cylindrical burner tube 26, at the back by the closure wall 22 and at the front by a baffle ring 28 secured by screws 27. The inner diameter of the baffle ring is smaller than the inner diameter of the burner tube. The burner tube 26 and the baffle ring 28 should be of corrosion and heat-resistant material having a low thermal conductivity, such as ceramic, ceramic fibres or refractory stone. Desirably, the material has closed pores; otherwise the burner tube 26 should be provided with a hermetic sleeve (not shown).

During normal operation, a flame front 29 is formed in this combustion chamber 25. The axial speed of the rotatingly introduced air jet is less than the re-ignition speed of the flame. In the illustrated example of fuel gas and air of combustion supply, an inner annular eddy 30 and an outer annular eddy 31 are produced. Both ensure that any unburnt fuel is returned to the flame front 29. The outer annular eddy 31 is released from the outer face of the flame front and extends considerably beyond the flame front. The gases of the annular eddy then extend along a path 32 at the circumference 33 of burner tube 26 up to the closure wall 22 where the flow is directed inwardly to a vacuum region produced by the entering air of combustion. The gases of the outer annular eddy 31 are hot and prevent the flame from being cooled by the burner tube 26.

An ionisation measuring electrode 35 provided in the closure wall 22 is always disposed in the path 32 of the outer annular eddy 31. This is true irrespective of the fact that the flame front 29 can have different axial spacings from the closure wall 22 depending on the set supply of fuel and the supply of air of combustion depending thereon. Consequently, the presence of the flame will always be detected irrespective of the particular operation. In the present case, the ionisation measuring path is formed between the illustrated electrode 35 and earth. It is, however, also possible to provide two such measuring electrodes in the closure wall 22 or in the burner tube 26 near the closure wall.

On starting the vapour burner, the heating apparatus 7 is first of all switched on. Following a certain time delay, a valve is opened for the supply of fuel. The supply of pressure can be very low, for example 0.1 bar. As soon as the first drop of liquid has reached the gasifying chamber 1, it is vaporised. With the air contained in chamber 1, the gas forms an ignitable mixture which is ignited at the glow zone 17. The flame so formed is pushed into the combustion chamber 25 by the next following fuel gas. The next following gas mixes with the air of combustion supplied through the passage system K. The combustible mixture thus formed is ignited by the aforementioned flame. The flame front is gradually displaced towards the right until the burner is operated at the set power. During this gradual building up of the flame front, the outer annular eddy 31 already serves to protect the burner tube 26 from cooling.

The lower the burner power, the greater will be the tendency of the flame to be unstable if the burner is not operated with a considerable excess of air. In contrast, with the aid of the outer annular eddy 31 it is possible to achieve a stable flame at the flame front 29 even with excess air near zero when only little fuel is being supplied, e.g. less than 1 kg/h, for example 0.6 kg/h.

Even shortly after starting, the inner surface 33 of burner tube 26 will assume a glow temperature. This results in further stabilisation of the flame. By reason of the intensive back radiation, there will be effective gasification of any fuel droplets contained in the gas jet between the gasifying tube and the flame front. Because of this back radiation as well as the outer annular eddy 31, the temperature of the flame core has very rapidly reached the operating temperature. It is so high that no soot can exist and the flame is completely transparent.

The thermal energy is supplied to the heating apparatus 7 by a switching device 36 which is energised by a voltage source 37, for example the normal A.C. mains, and controlled by a control device 38. This control device also controls a valve 60 in the fuel supply 61 and a valve 62 in the air supply 63. Information is supplied to the control device by way of inlets 64, for example from a boiler thermostat, from the measuring electrode 35, from an exhaust gas sensor and the like.

On extinction of the flame during operation, e.g. because of momentary lack of fuel on account of an air bubble in the system, re-ignition takes place at the wall of the combustion chamber so that the flame is immediately re-established without formation of soot.

A time generator in the control device 38 ensures that the fuel will not be switched off during a predetermined safety period if a measuring sensor, for example the measuring electrode 35, notifies the control device 38 that walls of the combustion chamber 25 are at glow temperature.

Back radiation also makes it possible to reduce the heating power of the heating apparatus 7, even at the risk of incomplete gasification causing drops of fuel to leave aperture 6 together with the gasified fuel. This reduction is likewise effected by the control device 38. A certain time after detecting the flame, it will, through the measuring electrode 35, transmit a signal for reducing the electric heating power. The heating power can in this way be reduced by more than 25%.

The hollow cylindrical burner tube 26 can also be made from a material having a high thermal conductivity, such as steel. This will also protect flame. It will, however, take comparatively long to reach a stable operating temperature.

In such a vapour burner, the noise of the air and the noise of the flame have a very high frequency. These noises cannot be transmitted through a normal hot water heating system as are the low frequency flame noises produced in atomising burners. The high frequency noises can be very easily damped. In particular, the damping produced by thermal insulation will suffice. Adequate damping will, for example be produced if the burner tube 26 is made from rock wool.

Figure 2:
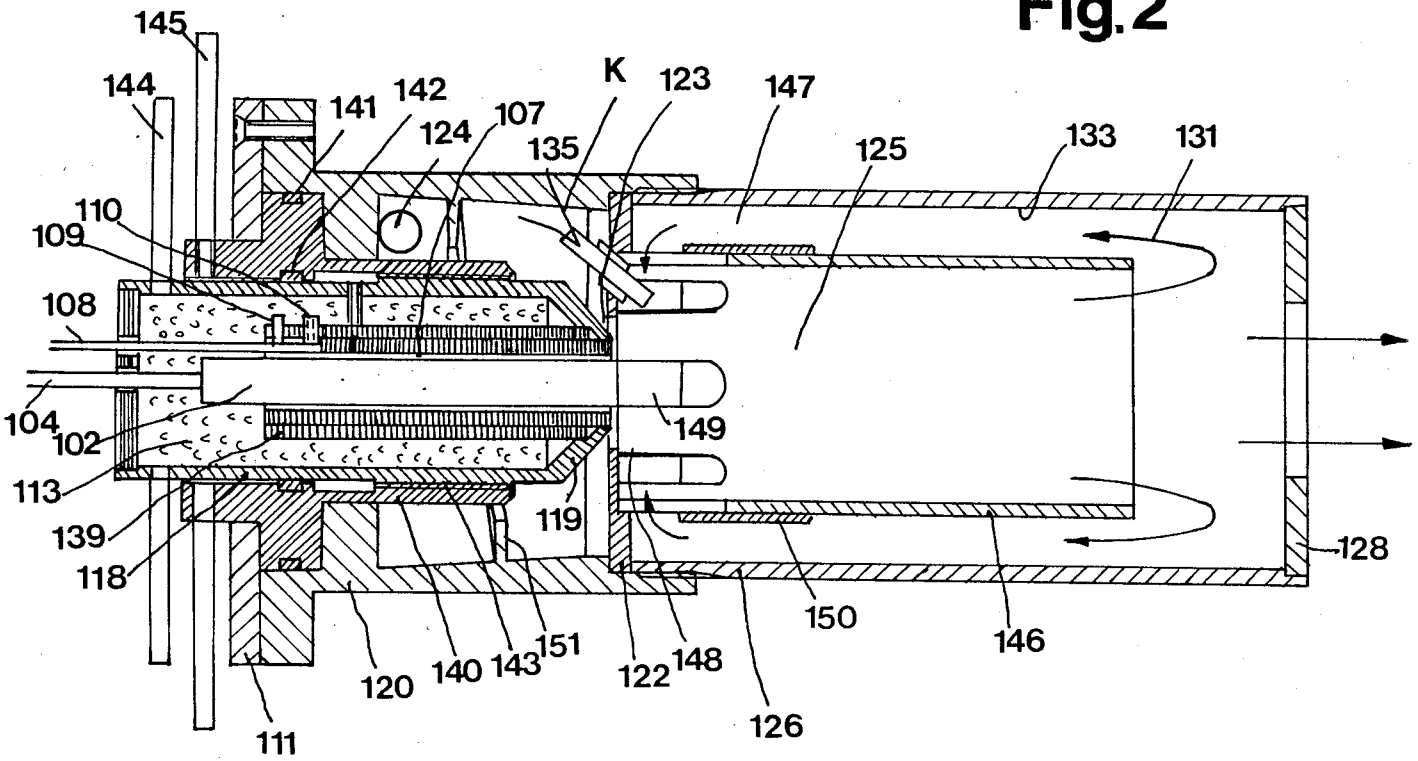
FIG. 2 is a longitudinal section through a second embodiment.

In the FIG. 2 embodiment, corresponding parts have reference numerals increased by 100. In this case, the gasifying tube 102, heating apparatus 107, two insulating sleeves 139 and the thermal insulation 113 are directly accommodated in a sleeve 118 having a front conical wall 119. Between a housing portion 111 and the burner head 120 connected thereto as well as the sleeve 118, there is a rotary member 140 with the interpositioning of seals 141 and 142, the rotary member engaging the sleeve 118 by way of a screwthread 143. The conical wall 119 can be axially adjusted with the aid of handles 144 or 145 on the sleeve 118 or on the rotary member 140 so that the mouth 123 in the form of an annular gap can be changed in size.

A guide tube 146 in the combustion chamber 125 is arranged within the burner tube 126 to leave a return flow path 147 and is secured to the closure wall 122 by struts 148. Slots 149 are left therebetween. The guide tube 146 terminates at a spacing in front of the baffle ring 128. A sleeve 150 is displaceable on the guide tube 146 and covers the apertures 149 to a greater or less extent. In this construction, the outer annular eddy 131 extends about the front edge of the guide tube 146, through the return flow passage 147 and the apertures 149. The guide tube 146 is heated extremely rapidly. Guide walls 151 built into the passage system K serve to give the air of combustion a strong twist even when the air is introduced into the combustion chamber 125 at a low pressure and low speed.

Figure 3:
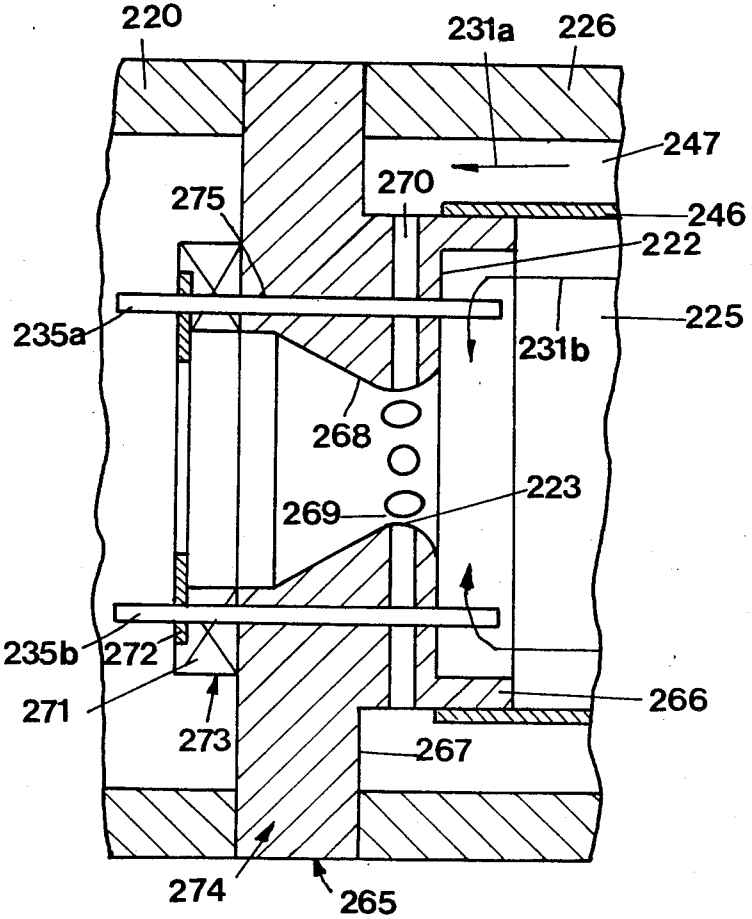
FIG. 3 is a part-section through a third embodiment.

In FIG. 3, corresponding parts bear reference numerals increased by a further 100. A constructional unit 265 comprises the closure wall 222 within the guide tube 246 and a cylindrical flange 266 carrying this guide tube, also an end wall 267 bounding the return flow passage 247, the outer guide wall 268 for the passage system in the vicinity of the mouth 223 where there is a minimum cross-section 269, and radial connecting passages 270 which start between the end wall 267 and closure wall 222 and open in the vicinity of the smallest cross-section 269. Guide blades 271 to produce twist also form part of the constructional unit 265; they are covered at the back by an annular plate 272. The constructional unit 265 consists of a first member 273, which comprises the annular plate 272 and the guide blades 271, and a second member 274 which comprises the other components. Both parts are provided with axial holes 275 through which pins **235*a* and 235*b*** pass. These pins at the same time serve as ionisation measuring electrodes.

In this construction, the outer annular eddy is divided into two parts, namely an outer part **231*a* which extends through the return flow passage 247 between the guide tube 246 and burner tube 226 and subsequently through the connecting passages 270, and an inner part 231*b* which flows back along the inside of the guide tube 246 and thereby sweeps the measuring electrodes 235*a* and 235*b* projecting into the combustion chamber through the closure wall 222. The outer part 231*a* of the outer annular eddy is propelled very strongly because the connecting passages 270 open at the smallest cross-section 260** where the air is guided with the highest speed of flow and therefore at the strongest vacuum. consequently, the fuel-air mixture is supplied with a corresponding proporation of circulating hot gases which facilitates gasification of any fuel droplets still present in front of the flame front.

Figure 4:
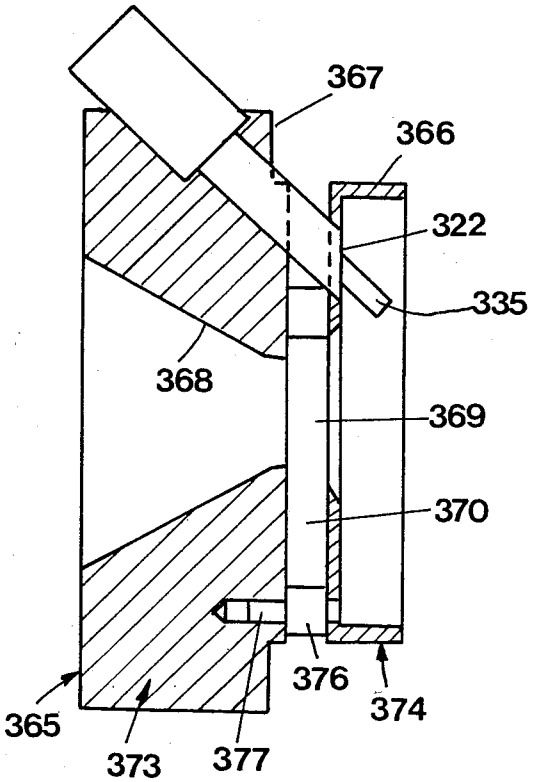
FIG. 4 is a section through a constructional unit of a fourth embodiment.

In the FIG. 4 embodiment, corresponding parts have reference numerals increased by a still further 100. In this case the constructional unit 365 consists of two simply shaped parts 373 and 374 which are unified by pins 377 with the interpositioning of spacer rings 376. There therefore remains a gap-shaped connecting passage 370 between the closure wall 322 and the end wall 367.

The constructional units 265 and 365 can be produced from sintered ceramic parts which are collected on the pins as raw material and thereby adhere to each other. This unit is then dried and subsequently fired or sintered.

The principle here described permits operation with little or no excess air at a soot number of zero irrespective of the amount of fuel fired. There is stoichiometric combustion of the fuel without the formation of sulphur trioxide so that the system permits operation at minimum outlet temperature, i.e. at maximum cooling of the exhaust gas. Combustion during starting as well as operation is so clean that the burner can even operate as a submerged burner and in conjunction with condensing heat exchangers. It is also possible to operate without soot production with a certain sparsity of air. The flame is protected from undesirable condensation of the gasified fuel irrespective of its size. The outer annular eddy heats walls of the combustion chamber in such a way that any fuel droplets still present become gasified before they reach the flame front. If the walls glow, the flame can even be re-ignited during operation after momentary extinction. Even during starting, the burner operates with a pure blue flame. Simplifications are also obtained for the accessories. Thus, one requires only one fairly quiet low pressure pump for the fuel because no pressure is required that exceeds a maximum of 0.5 bar. Resonance noises in oil lines and tanks are therefore avoided. The noises of the flame are also substantially less and can be more easily damped because of the higher frequency. Further, one reqires no rapidly acting separating still sufficient for gasifying any subsequent drops of fuel.

We claim:

1. A vapour burner, comprising, elongated supply means for supplying and discharging fuel in a gasified form, said supply means including a tubular member having a front outlet through which gasified fuel is discharged, an air supply passage system surrounding said tubular member, said air supply system having an inlet through which air is supplied tangentially relative to said tubular member to produce a rotating and axially moving column of air surrounding said tubular member, means for defining a combustion chamber that has a radially outer periphery and a rear end, the means defining the combustion chamber including an axially elongated cylindrical shaped burner tube having a rear end portion axially adjacent to the tubular member outlet and radially spaced therefrom and a front end portion axially forwardly remote from the tubular member outlet, the burner tube being of a substantially larger diameter than the tubular member and defining the radial outer periphery of a combustion chamber, and an annular closure wall defining the rear end of the combustion chamber and having a central opening forming an inlet to the combustion chamber, the annular closure wall extending between the air supply passage system and the burner tube rear end portion, and in cooperation with the air supply system forming a mouth through which air supplied at the air system inlet passes to the combustion chamber inlet, said air supply system including guide means inclined relative to and cooperable with said closure wall for radially converging said rotating column of air in a forward direction adjacent to said mouth to pass through the combustion chamber inlet, said guide means including a concial front guide wall that is spaced from the closure wall and in cooperation with the closure wall form an annular gap through which the column of air moves to and through the combustion chamber inlet and into the combustion chamber as a conical jet, said conical wall having a front opening through which fuel from the supply means passes toward the combustion chamber and a rear end of a greater inner diameter than the diameter of its front opening.

2. The apparatus of claim 1 further characterized in that the diameter of the combustion chamber inlet is smaller than the maximum diameter of said conical wall and that the maximum diameter of the closure wall is greater than the maximum diameter of the conical wall.

3. The apparatus of claim 1 further characterized in that the air passage supply system includes an elongated first tubular portion having a rear end and a front end joined to said conical wall.

4. The apparatus of claim 3 further characterized in that the air passage system includes an elongated second tubular portion having a front end abutting against the closure wall and surrounding the first tubular portion for having the column of air move in a forward direction between the tubular portions.

5. A vapour burner that utilizes liquid fuel and is operable to produce combustion, comprising, tube means forming an electrically heatable gasifying chamber and having an inlet end and an outlet end, said tube means inlet end having an opening through which liquid fuel is supplied, operable means for supplying a gasifiable liquid fuel to said tube means to be gasified in the gasifying chamber, an air supply passage system surrounding said tube means, said air supply passage system having an air inlet through which air is supplied tangentially relative to said tube means to produce a rotating and axially moving column of air surrounding said tube means, a cylindrically shaped burner tube having a front end and a rear end portion surrounding the outlet end of said tube means, and extending forwardly of the tube means to in part form a combustion chamber, an annular closure wall between the rear end portion of said burner tube and said air supply passage system that defines the rear end of the combustion chamber and in conjunction with the air supply passage system forms a mouth for said gasifying chamber and said air supply passage system at the rear end portion of said combustion chamber, said closure wall opening to the combustion chamber, said air supply passage system including guide means inclined relative to and cooperable with said closure wall for radially converging said rotating and axially moving column of air in the vicinity of said mouth to produce an external annular eddy current of combustion gases that extends rearwardly along the inside of said burner tube to said closure wall at least over a section thereof disposed axially in front of said mouth of said gasifying chamber when combustion is taking place in the combustion chamber, said guide means including a conical front guide wall that in conjunction with the closure wall forms a gap therebetween through which said column of air moves and is introduced through the closure wall opening into the combustion chamber as a conical air jet, the conical wall having a central opening spaced from the tube means for passage of gasified fuel toward the combustion chamber.

6. A vapour burner according to claim 5 wherein the tube means includes means defining a glow zone near said mouth for igniting fuel.

7. A vapour burner according to claim 6 wherein said conical guide wall is axially adjustable relatively to said closure wall which bounds said mouth.

8. A vapour burner according to claim 5 wherein said tube means has at least one outlet aperture disposed adjacent to said closure wall.

9. A vapour burner according to claim 5 wherein said guide means has guide blades in said air supply passage system to produce a twist in the air of combustion.

10. A vapour burner according to claim 5 wherein guide tube means is mounted by the closure wall in said combustion chamber for extending at a spacing within said burner tube and forming along the inner surface of said burner tube a return flow passage for the outer annular eddy current to said mouth.

11. A vapour burner according to claim 10 wherein said guide tube means includes a guide tube secured to said closure wall and has circumferential apertures adjacent to said closure wall, and an axially adjustable sleeve means is provided on said guide tube for adjustably varying fluid flow through said apertures.

12. A vapour burner according to claim 10 wherein uniformly circumferentially arranged connecting passages lead from said return flow passage to said mouth, said guide tube means means having an inlet adjacent to the closure wall, the connecting passages being associated with said closure wall and extending to the inlet of said guide tube.

13. A vapour burner according to claim 12 wherein said closure wall has a surrounding cylindrical flange for holding said guide tube means axially offset from said return flow passage and a center throttling section with a minimum cross-section and at least one connecting passage in said wall means extending from said return passage and opening into said minimum cross-section.

14. A vapour burner according to claim 13 wherein the first mentioned guide means includes guide blade means in the air supply passage system to produce a twisting of the air of combustion.

15. A vapour burner according to claim 14 wherein said closure wall and guide blade means have aligned axial holes, and connecting pins extented through said axial holes and into the combustion chamber to serve as ionization measuring electrodes.

16. A vapour burner according to claim 10 including at least one flame monitoring ionisation measuring electrode in the return flow of said external annular eddy current, said measuring electrode being disposed in said guide tube means.

17. A vapour burner according to claim 5 wherein there is provided a baffle ring that is joined to the front end portion of said burner tube and has an inner diameter that is smaller than the inner diameter of the burner tube.

18. A vapour burner according to claim 5 wherein said burner tube is of a heat resistant material having a low thermal conductivity.

19. A vapour burner according to claim 18 wherein said thermal conductivity is so low that said burner tube glows during operation in the region of said external eddy current.

20. A vapour burner according to claim 5 wherein there is provided at least one ionisation measuring electrode extended within the combustion chamber in the return flow of said external annular eddy current for detecting the prescence of a flame in the combustion chamber.

21. A vapour burner according to claim 20 wherein said measuring electrode is mounted in said annular closure wall.

22. A vapour burner according to claim 20 wherein the electrode has a portion in the combustion chamber that is heatable to a glow temperature while flaming combustion is taking place in the combustion chamber, and there is provided control means for operating the means for supplying fuel to start the supply of fuel to the tube means; and after the electrode portion is heated to a glow temperature, to continue to supply fuel to the tube means for a predetermined time after there is a momentary discontinuance of combustion in the combustion chamber, provided the electrode portion has reached and remains at a glow temperature, and if not, operate the supply means to terminate the supply of fuel to the tube means.

23. A vapour burner according to claim 20 wherein the burner tube has a portion that is heatable to a glow temperature when combustion is taking place in the combustion chamber, and there is provided control means for operating the fuel supplying means to start the supply of fuel to the tube means; and after said burner tube portion is heated to a glow temperature due to combustion taking place in the combustion chamber, in the event of momentary discontinuance of combustion in the combustion chamber, continue to supply fuel for a predetermined period of time, provided the said portion of the burner tube is still at a glow temperature, and if not, operate the supplying means to discontinue the supply of fuel to the tube means.

24. A vapour burner according to claim 5 wherein the operable means for supplying a gasifiable liquid fuel includes means mounted by the inlet end of the tube means for permitting the ingress of only liquid fuel through the tube means inlet end.

* * * * *